United States Patent [19]

Iwasaki

[11] 4,019,341

[45] Apr. 26, 1977

[54] HEAT EXCHANGING PROCESS OF REFRIGERANT GAS IN REFRIGERATOR

[76] Inventor: Moritaka Iwasaki, 10-1, Idogaya Nakamachi, Minami, Yokohama, Kanagawa, Japan

[22] Filed: Dec. 3, 1975

[21] Appl. No.: 637,411

[52] U.S. Cl. ..... 62/277

[51] Int. Cl.[2] ..... F25B 47/00

[58] Field of Search ..... 62/277, 151, 352, 278

[56] References Cited

UNITED STATES PATENTS

| | | | |
|---|---|---|---|
| 2,440,146 | 4/1948 | Kramer | 62/277 |
| 3,511,060 | 5/1970 | Bodcher | 62/278 |
| 3,638,444 | 2/1972 | Lindahl | 62/277 |
| 3,838,582 | 10/1974 | Redfern et al. | 62/278 |

*Primary Examiner*—Lloyd L. King
*Attorney, Agent, or Firm*—Cushman, Darby & Cushman

[57] ABSTRACT

A refrigerating fluid which has passed through the cooler of a refrigerating apparatus during the defrosting cycle and is thus partially liquid and partially gaseous, is fed under pressure into a heat exchanger containing a radiator and a plurality of expansion tanks. The refrigerating fluid in the combined gaseous and liquid state is fed into the evaporating tank about which hotter air is circulated by means of an air circulating fan which causes warm air coming from the radiator to be circulated about the tanks, thus causing an increase in temperature of the fluid causing it to evaporate and leaving no remaining liquid as the fluid leaves the evaporating tanks. The gaseous fluid is then directed to the compressor by which it is fed into a radiator where it tends to heat the radiator, thus providing the warm air for circulation over the evaporator tank. The refrigerant fluid is then passed in the gaseous state from the radiator to the cooler wherein it defrosts the evaporating coils in the cooler and is thus returned to a partially liquid and partially gaseous fluid which is then recirculated to the evaporating tanks of the heat exchanger, completing the cycle.

1 Claim, 2 Drawing Figures

HEAT EXCHANGING PROCESS OF REFRIGERANT GAS IN REFRIGERATOR

BACKGROUND OF THE INVENTION

1. Field of the Invention

The present invention relates to an apparatus for defrosting the evaporator coil of a conventional refrigeration unit, more particularly, the invention relates to an apparatus for applying heat to the refrigerating fluid in the heat exchanger during the defrosting cycle.

2. Prior Art

Conventional apparatus utilize a heat exchanging process during the defrosting cycle wherein the refrigerating fluid is fed under pressure to a cooler by means of a compressor so as to defrost the inside of the cooler. After expanding and evaporating the refrigerating fluid by circulating the fluid to the heat exchanger and heating the fluid by water circulation in heat exchange relationship with the fluid, the gas is intended to be vaporized so that no liquid will pass back through the compressor. A difficulty which arises in such prior art devices is that in the heat exchange process the refrigerating fluid is cooled by the circulated water in a heat exchange relationship with the fluid in such a manner that it is not completely efficient in the expansion and evaporaton of the refrigerating fluid and therefore, the fluid is incompletely evaporated leaving some of the fluid in a liquid state instead of entirely in a gaseous state as it is passed through the compressor, causing it to damage the compressor or substantially reduce the efficiency thereof.

SUMMARY OF THE INVENTION

This invention is intended to overcome the above described difficulties and disadvantages associated with prior art devices in that it provides a heat exchanging process wherein the refrigerant moved through the system during the defrosting cycle is expanded and evaporated in a much more efficient manner than has been available with prior art devices.

According to the present invention, the refrigerating fluid which has passed through the cooler during the defrosting cycle and is thus partially liquid and partially gaseous, is fed under pressure into a heat exchanger containing a raditor and a plurality of expansion tanks. The refrigerating fluid in the combined gaseous and liquid state is fed into the evaporating tank about which hotter air is circulated by means of an air circulating fan which causes warm air coming from the radiator to be circulated about the tanks, thus causing an increase in temperature of the fluid causing it to evaporate and leaving no remaining liquid as the fluid leaves the evaporating tanks. The gaseous fluid is then directed to the compressor by which it is fed into a radiator where it tends to heat the radiator, thus providing the warm air for circulation over the evaporator tank. The refrigerant fluid is then passed in the gaseous state from the radiator to the cooler wherein it defrosts the evaporating coils in the cooler and is thus returned to a partially liquid and partially gaseous fluid which is then recirculated to the evaporating tanks of the heat exchanger, completing the cycle.

DETAILED DESCRIPTION OF THE PREFERRED EMBODIMENT

Figure 1:
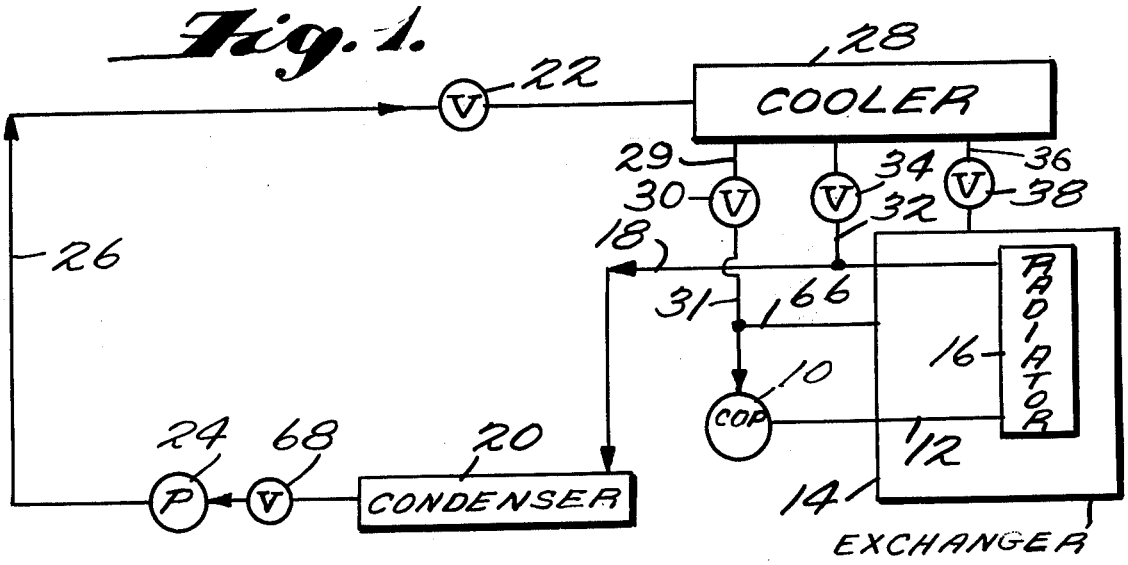
FIG. 1 is a schematic illustration of a refrigerating-/defrosting cycle utilizing the heat exchanger of the present invention.

Referring to FIG. 1, during the refrigerating cycle beginning with the refrigerant fluid leaving the compressor 10, the fluid passes through conduit 12 into heat exchanger 14 wherein it enters the radiator 16. In the radiator 16 heat is removed from the refrigerating fluid and it is then passed through conduit 18 to condenser 20 wherein it is condensed. The condensed refrigerant fluid is then passed through a high pressure expansion valve 22 by means of refrigerant pump 24 via conduit 26. As the refrigerant fluid is passed through the expansion valve 22 it vaporizes and the vapor is then fed through the evaporation coil (not shown) of the cooler 28 causing a heat exchange therewith which removes heat from the cooler which heat is added to the refrigerant fluid. The refrigerant fluid then passes via conduit 29 through the electromagnetic valve 30 back to the compressor 10 via conduit 31, completing the refrigerating cycle.

During the defrosting cycle, beginning again with the refrigerant fluid as it leaves the compressor 10, as is best illustrated in FIG. 2, the refrigerant again passes through conduit 12 into the radiator 16 wherein some heat is removed from the refrigerating fluid. The refrigerating fluid is then passed through the evaporation coils of the cooler 28 via conduit 32 through electromagnetic valve 34. Heat is transferred to the cooler from the relatively high temperature refrigerating fluid. The fluid then passes out of the cooler through conduit 36 at a lower temperature, through low pressure valve 38 and into the heat exchanger 14. In the heat exchanger 14, the refrigerant fluid is passed via conduit 40 into a plurality of evaporation tanks 42, 44 and 46 via feeder lines 48, 50 and 52. The refrigerant fluid at this point contains both liquid and gas. The tanks are designed to have relatively thin outer walls so that sufficient heat transfer can be supplied by the air circulating thereabout, in a manner described below, so that the refrigerant fluid will be in a completely gaseous state when it leaves the heat exchanger 14.

After the refrigerant fluid enters the tanks 42, 44 and 46 through conduits 48, 50 and 52, respectively, it circulates through the outer tank and then into outlet conduits 60, 62 and 64 respectively. At this point the refrigerant fluid should be in a substantially completely gaseous state. The refrigerant fluid then flows through conduit 66 to the compressor 10, completing the defrosting cycle.

Since, in the preferred embodiment the same conduit 12 is utilized in both the refrigerating and defrosting cycles, a high pressure valve 68 is utilized downstream from the condensor 20 that when the refrigerant fluid leaves the radiator via conduit 18 it will be caused to pass through valve 34 during the defrosting cycle, rather than passing through the condensor, which is undesirable. Likewise, during the defrosting cycle, valve 30 is closed to prevent the refrigerating fluid coming from the heat exchanger via conduit 66 from passing back into the cooler, the refrigerant fluid will be passed through the compressor 10 and into the radiator via conduit 12. Thus, essentially, during the defrosting cycle, the refrigerating fluid will circulate through valves 34 and 38 rather than through valves 22 and 30 as it does during the refrigerating portion of the cycle.

Obviously during the refrigerating cycle valves 34 and 38 are closed to prevent flow therethrough thus effectively removing the evaporation tanks from the fluid flow path, while valve 30 is open. All of the valves 30, 34 and 38 can be controlled by a simple electrical circuit (not shown) to provide the above-described operation.

Figure 2:
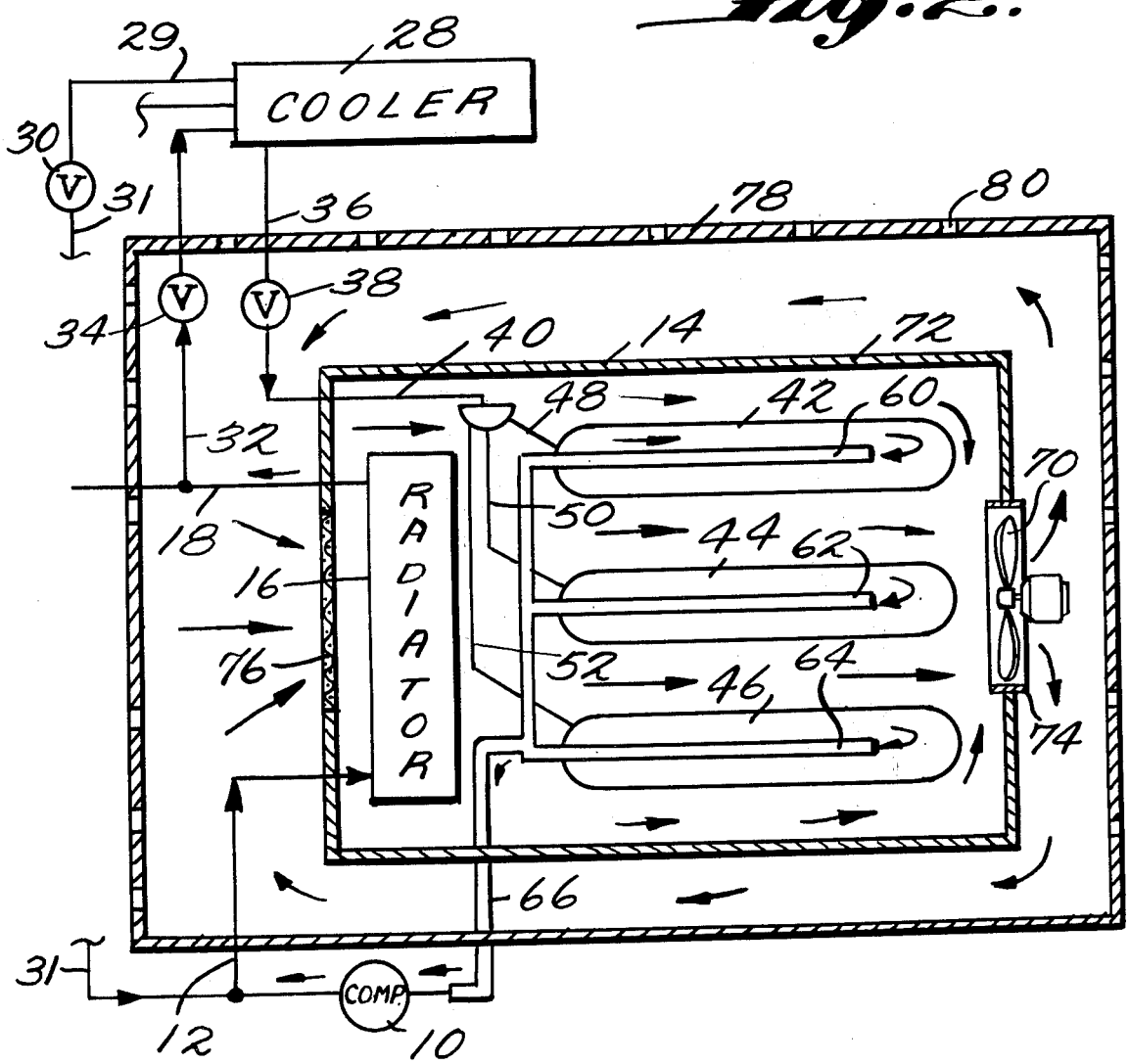
FIG. 2 is an expanded schematic view of the heat exchanger of FIG. 1 illustrating the preferred embodiment of the present invention.

Referring back to the heat exchange unit as illustrated in FIG. 2, a fan 70 is positioned at one end of evaporation tanks 42, 44 and 46, opposite from the end at which radiator 16 is positioned, so that air will circulate from the radiator across the surfaces of the evaporator tanks and out through the opening in which the fan 70 is positioned. In this regard, a housing 72 is provided with an opening 74 in which the fan 70 is positioned. In the opposite end of housing 72 is a vent or opening 76 through which air may be drawn to circulate through the radiator 16. An outer housing 78 is further provided encompassing both the radiator and evaporator tanks as well as housing 72. The outer housing is provided with ventilation holes or openings 80 throughout the exterior surface thereof to provide sufficient air circulation through the heat exchange equipment.

Although the foregoing description illustrates the preferred embodiment of the present invention, it will be apparent to those skilled in the art that variations are possible. All such variations as would be obvious to those skilled in this art are meant to be included within the scope of this invention as defined by the following claims.

What is claimed is:

1. In a refrigeration system having:

a. a compressor for compressing a refrigeration fluid;

b. a heat exchanger including a radiator for subtracting heat from the compressed refrigeration fluid;

c. first conduit means for supplying the compressed refrigeration fluid from the compressor to the radiator;

d. a condenser for liquefying the compressed, cooled refrigeration fluid;

e. second conduit means for supplying the compressed, cooled refrigeration fluid from the radiator to the condenser;

f. an evaporator juxtaposed with a cooler from which heat is to be subtracted by the refrigeration fluid;

g. third conduit means connected with the evaporator for forwarding the compressed, cooled, liquefied refrigeration fluid towards the evaporator;

h. an expansion valve interposed in the third conduit means, for permitting evaporation of the compressed, cooled, liquefied refrigeration fluid to supply the evaporator therewith; and i. fourth conduit means for returning the evaporated, warmed refrigeration fluid from the evaporator to the compressor;

a defrosting system for defrosting the cooler, comprising:

the heat exchanger including :

an inner housing enclosing the radiator;

first opening means defining an air inlet to the inner housing;

second opening means defining an air outlet from the inner housing; and forced draft means for pulling air into the inner housing through the first opening means, flowing the air over the radiator to subtract heat from the radiator, and pushing the heated air out the second opening means;

the defrosting system further including:

fifth conduit means interconnecting the radiator with the evaporator for supplying refrigeration fluid from the evaporator to the evaporator;

switching valve means between the second and fifth conduit means for determining whether the refrigeration fluid leaving the radiator will be forwarded to said condenser for refrigeration or to said evaporator for defrosting;

expansion chamber means interposed within said inner housing between the radiator and the second opening means, so that the air passing in forced draft within the inner housing passes in heat exchanging relation with the expansion chamber means after this air passes in heat exchanging relation with the radiator, to heat fully vaporized refrigeration fluid in the expansion chamber means;

sixth conduit means connecting the evaporator with the expansion chamber means;

valve means interposed in the fourth and sixth conduit means for determining that the refrigeration fluid will flow through the sixth conduit means while the cooler is being defrosted and through the fourth conduit means while the cooler is being refrigerated; and seventh conduit means for returning heated refrigeration fluid from the expansion chamber means to the compressor.

* * * * *